US006128863A

United States Patent [19]

Millay

[11] Patent Number: 6,128,863

[45] Date of Patent: Oct. 10, 2000

[54] FISH AND MARINE MAMMAL OBSERVATORY FEATURING A CAROUSEL THAT MOVES WITHIN A SEALED AQUATIC ENVIRONMENT

[75] Inventor: George D. Millay, Grand Prairie, Tex.

[73] Assignee: SeaVenture, a Nevada Limited Liability Company, Grand Prairie, Tex.

[21] Appl. No.: 09/344,331

[22] Filed: Jun. 24, 1999

[51] Int. Cl.[7] ..... E04B 1/346

[52] U.S. Cl. ..... 52/65; 52/67; 52/169.1; 114/314; 119/246; 119/255; 119/256; 405/195; 405/210; 472/2; 472/13; 472/29; 472/128; 472/137

[58] Field of Search ..... 52/29, 64, 65, 52/67, 169.1, 169.6, 169.7, 171.1, 234, 236.1–236.3; 114/65 R, 66, 314, 339; 472/1, 2, 13, 29, 48, 128, 136, 137; 119/245, 246, 247, 249, 250, 251, 255, 256; 104/53; 405/195, 210

[56] References Cited

U.S. PATENT DOCUMENTS

| | | | |
|---|---|---|---|
| 694,468 | 3/1902 | Gaillac . | |
| 710,044 | 9/1902 | Davidson . | |
| 728,062 | 5/1903 | Wilson . | |
| 743,968 | 11/1903 | Wilson . | |
| 950,348 | 2/1910 | Ross et al. . | |
| 1,016,808 | 2/1912 | Williamson . | |
| 1,313,838 | 8/1919 | Stodder . | |
| 3,114,333 | 12/1963 | Fowler et al. . | |
| 3,240,186 | 3/1966 | Dobell . | |
| 3,390,640 | 7/1968 | Couttet et al. . | |
| 3,527,184 | 9/1970 | McCarty et al. . | |
| 3,680,515 | 8/1972 | Yoneda et al. | 114/66 |
| 3,708,991 | 1/1973 | Barkley . | |
| 3,895,495 | 7/1975 | Akazaki et al. | 61/46 |
| 3,905,166 | 9/1975 | Kaiser | 52/65 |
| 4,087,980 | 5/1978 | Kono . | |
| 4,186,532 | 2/1980 | Kahn . | |
| 4,904,118 | 2/1990 | Theimann, III | 405/195 |
| 4,928,614 | 5/1990 | Forman . | |
| 5,149,304 | 9/1992 | Purser | 472/131 |
| 5,215,016 | 6/1993 | Futami . | |
| 5,564,983 | 10/1996 | Larson . | |
| 5,603,189 | 2/1997 | Levy | 52/169.1 |
| 5,689,917 | 11/1997 | St-Germain | 52/7 |
| 5,775,226 | 7/1998 | Futami et al. . | |

OTHER PUBLICATIONS

"The Pike On The Silverstrand", Historical Society of Long Beach—Journal 1982–1983, p. 70.

*Primary Examiner*—Carl D. Friedman
*Assistant Examiner*—Yvonne M. Horton
*Attorney, Agent, or Firm*—David H. Judson

[57] ABSTRACT

A fish and marine mammal aquatic observatory. The observatory comprises an outer cylindrical wall and an inner cylindrical wall that define an enclosed annular volume. The inner cylindrical wall is formed of a transparent material, e.g., glass or reinforced plastic. The enclosed annular volume is partially filled with a body of sea water that includes fish and marine mammal animals and other aquatic plants. The observatory further includes a carousel or platform supported on a tower located along a longitudinal axis of the observatory. An outer diameter of the carousel substantially abuts the inner cylindrical wall of the observatory. The carousel is accessible to participants when located at a first or upper position above the enclosed annular volume of water. A lift mechanism moves the carousel from the first, upper position to a second, lower position within the enclosed annular volume of water. As the carousel moves between the first and second positions, it is also rotated to afford viewers a panoramic, substantially 360° view of the enclosed aquatic environment.

11 Claims, 4 Drawing Sheets

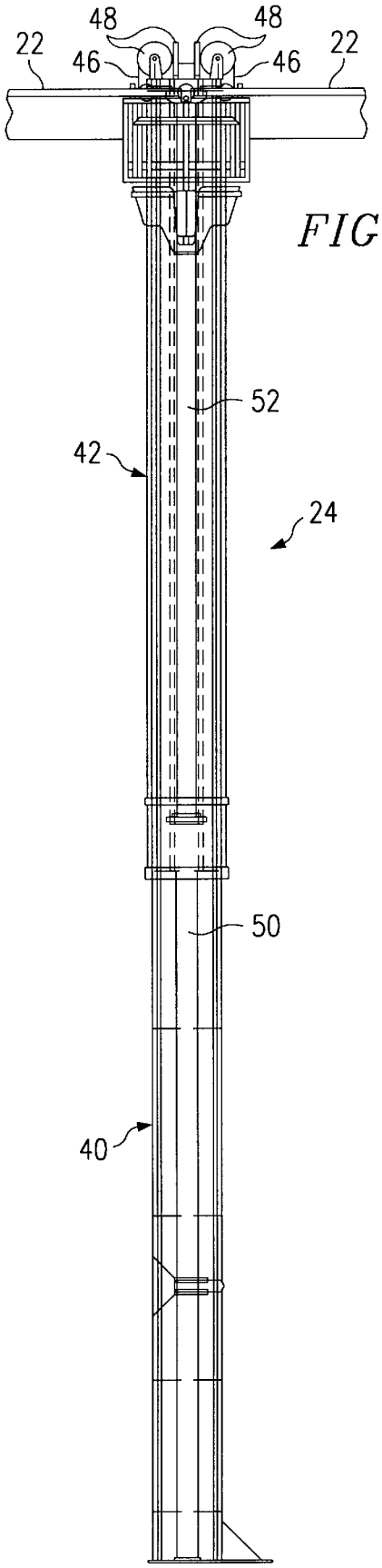
FIG. 2
FIG. 3
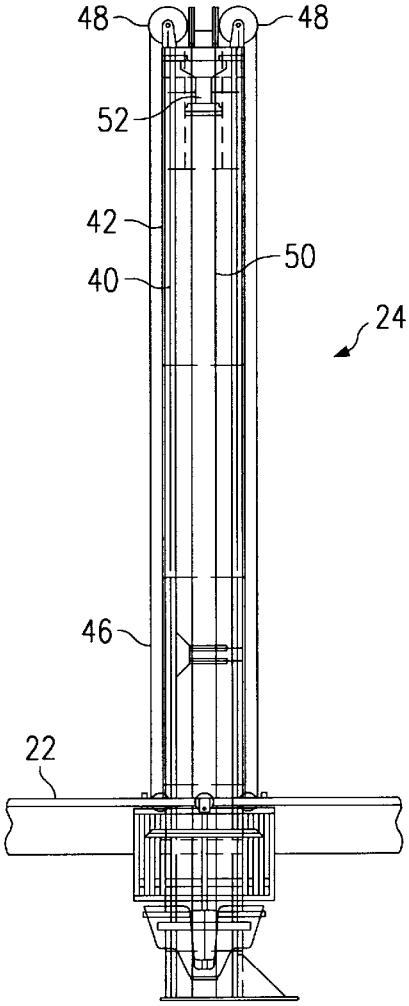

FISH AND MARINE MAMMAL OBSERVATORY FEATURING A CAROUSEL THAT MOVES WITHIN A SEALED AQUATIC ENVIRONMENT

BACKGROUND OF THE INVENTION

1. Technical Field

The present invention relates generally to entertainment and educational attractions and, in particular, to a fish and marine mammal observatory that includes a carousel that moves within a sealed aquatic environment to provide an entertainment and educational aquatic attraction.

2. Description of the Related Art

From time immemorial, the general public has been fascinated with undersea life. Adults and children alike find undersea creatures and their lives to be strange and fascinating. To truly explore the undersea world, however, specialized equipment is required. In addition, undersea exploration is a very dangerous undertaking.

The entertainment industry has addressed this need in several different ways. Over the past several years, numerous aquatic theme parks have been developed that include live aquatic attractions and shows. One such park is Sea World, which includes exhibitions showing fish and marine mammals in simulated live environments. These exhibitions are essentially large-scale aquariums that are viewed in the open air or in specialized buildings. In the latter case, a glass-enclosed tunnel or passageway is made within the building itself so that the viewer can browse the animals in a more "natural" habitat. Although these attractions are quite popular, aquariums often do not give the viewer the impression that they have actually entered the undersea world.

There are numerous prior art patents describing aquatic attractions, rides and observatories. A representative one is U.S. Pat. No. 4,186,532 to Kahn, which describes and illustrates an off-shore underwater observatory comprising a lower, submerged observation gallery fitted with at least one observation window and having a ceiling with an opening through which the observation gallery is accessible. A body of water is placed on top of the gallery such that the combined weight of the structure and the water exceeds the buoyancy. Thus, in the Kahn patent, people can enter the building and view the surrounding marine life. While the observatory described in Kahn has certain advantages, the attraction does not create the impression that the viewer is actually entering the marine world. Moreover, the variety of sea life available to the viewer is limited by the need for the proximity of the observatory to the shore. Further, the viewer must walk around the observatory to view the different observation positions. Prior art amusement rides also include diving bells and submarines. In these attractions, riders enter an enclosed bell or submarine, which is then submerged in an aquarium or lake. Once submerged, participants can observe the activities in the aquarium surrounding them. Representative patent art includes U.S. Pat. No. 3,114,333 to Fowler et al, U.S. Pat. No. 5,775,226 to Futumi et al., and many others. An illustrative submarine ride that is still popular today is located at Disneyland. In other diving bell rides, the bell is submerged into the ocean itself. These rides have the advantage of providing an authentic underwater experience. However, to maintain structural integrity, the window openings in most submergible devices are quite small. Moreover, many individuals have a fear of getting inside a small enclosed diving bell or vehicle.

There remains a need in the art to provide a fish and marine mammal aquatic attraction that overcomes the disadvantages of the prior art. The present invention solves this problem.

BRIEF SUMMARY OF THE INVENTION

The present invention describes a fish and marine mammal aquatic observatory. The observatory comprises an outer cylindrical wall and an inner cylindrical wall that define an enclosed annular volume. The inner cylindrical wall is formed of a transparent material, e.g., glass or reinforced plastic. The enclosed annular volume is partially filled with a body of sea water that includes fish and/or marine mammals, and other aquatic plants, urchins and sea life. The observatory further includes a carousel supported on a tower located along a longitudinal axis of the observatory. An outer diameter of the carousel substantially abuts the inner cylindrical wall of the observatory. The carousel is accessible to participants when located at a first or upper position above the enclosed annular volume of water. According to the invention, the observatory includes suitable electrical, hydraulic and/or mechanical control devices to move the carousel from the first, upper position to a second, lower position within the enclosed annular volume of water. As the carousel moves between the first and second positions, it is also preferably rotated to afford viewers a panoramic, substantially 360° view of the enclosed aquatic environment.

The foregoing has outlined some of the more pertinent objects and features of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the Preferred Embodiment.

BRIEF DESCRIPTION OF THE DRAWINGS

For a more complete understanding of the present invention and the advantages thereof, reference should be made to the following Detailed Description taken in connection with the accompanying drawings in which:

FIG. 2 is a side view of a telescoping column of a lift mechanism in its extended position;

FIG. 3 is a side view of the telescoping column of the lift mechanism in its lowered position.

DETAILED DESCRIPTION OF THE PREFERRED EMBODIMENT

Figure 1A:
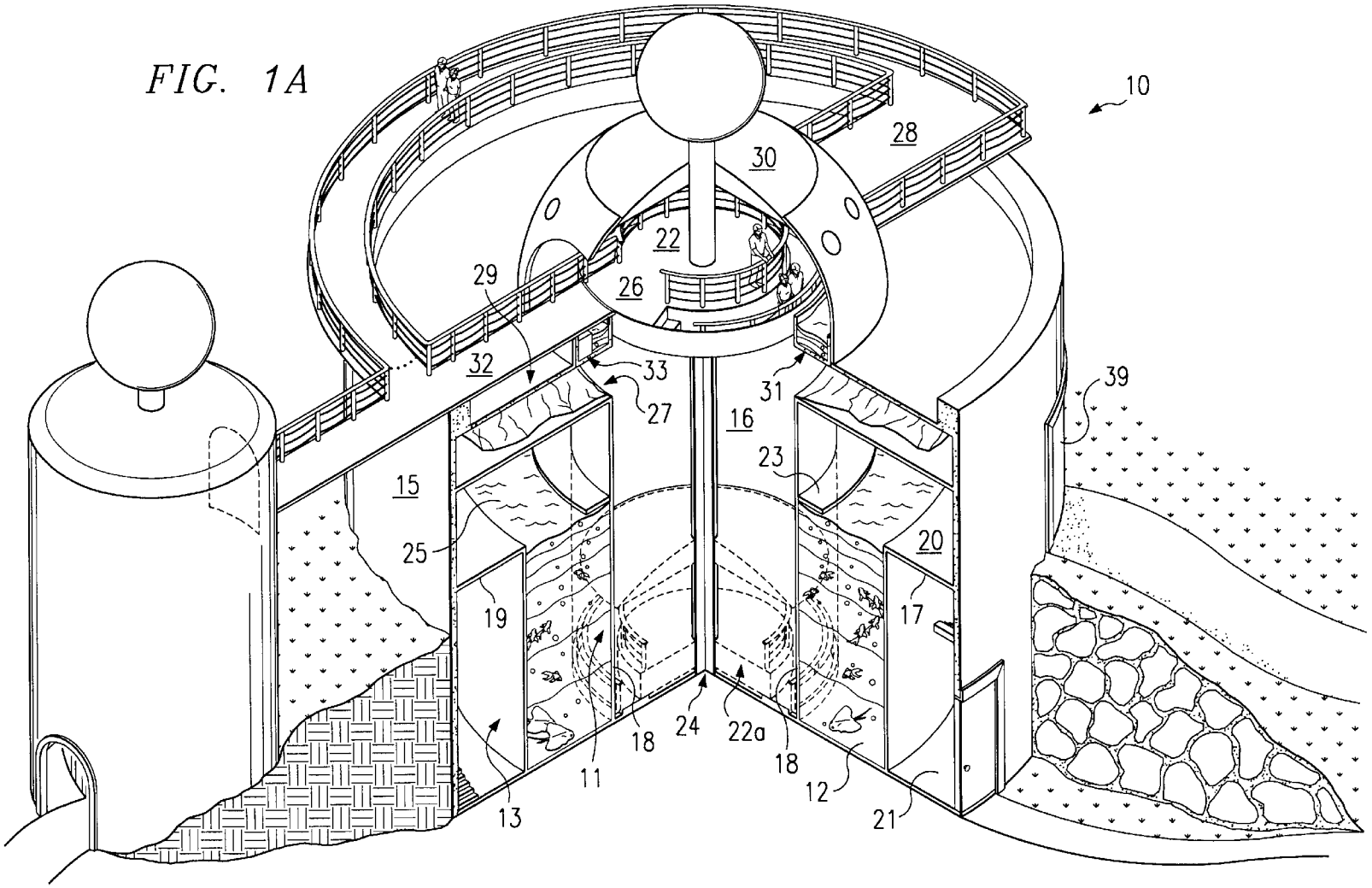
FIG. 1 is a cut-away perspective of a preferred embodiment of the present invention.

FIG. 1 is a cut-away perspective view showing a preferred embodiment of the present invention. The observatory 10 includes an inner cylindrical wall 11 and an outer cylindrical wall 13 that together define an annulus or enclosed annular volume 25. As illustrated, the annulus defined by the inner and outer cylindrical walls 11 and 13 is itself located within is a relatively larger cylinder that defines an outer portion of the observatory. This portion is defined by outside wall 15. As can also be seen, a wall 17 extends between a top edge of the inner cylindrical wall 11 and the outside wall 15. Wall 17 forms a walkway 20 that is accessible through a door 31. The walkway 20 is useful for access to the aquarium for feeding, cleaning and other necessary support activities. In addition, a wall 19 extends between a top edge of the outer cylindrical wall 13 and the outside wall 15 to define an inner access area 21 for maintenance personnel and the like. An emergency exit may also be accessed through the access area. A short cylindrical wall 23 is supported against inner cylindrical wall at a lateral position approximate that of the wall 19. The inner cylindrical wall underlying the wall 23 is transparent and formed of glass, reinforced plastic, or some other suitable material as is known in the art. The material must be of sufficient thickness to withstand the water pressure. The inner wall may include structural steel mullions, however, however, these mullions should be kept to a minimum to avoid obscuring the viewing area.

As can be seen, the enclosed annular volume or annulus encloses a body of water that includes aquatic attractions. Preferably, the water is seawater and includes fish, marine mammals, plants, and the like. The techniques for providing a suitable environment for such sea life and plants are well known in the art of marine biology. Appropriate mechanisms are supported within the building for this purpose. If desired, the inner surface of the outer cylindrical wall may be painted with marine murals. Simulated coral (e.g., fabricated of fiberglass) may also be provided. As illustrated in FIG. 1, the observatory is preferably fabricated below ground (or partially below ground) to provide structural integrity without the need for high-strength steel support frames. Alternatively, the observatory may be constructed entirely above ground or as a standalone building.

In this preferred embodiment, the observatory includes a dry exhibit 27 positioned within an annular volume located above the lateral wall 17. This exhibit, for example, illustrates a marine habitat. If desired, various segments of the dry exhibit may be devoted to different marine habitats. As also illustrated in FIG. 1, the observatory may include another lateral wall 29 extending inward from the outside wall and terminating in an annular pool 31. Pool 31 may comprise a wet exhibit, such as a tidal pool. A wave machine 33 may be provided in the tidal pool to simulate a surf.

Figure 1B:
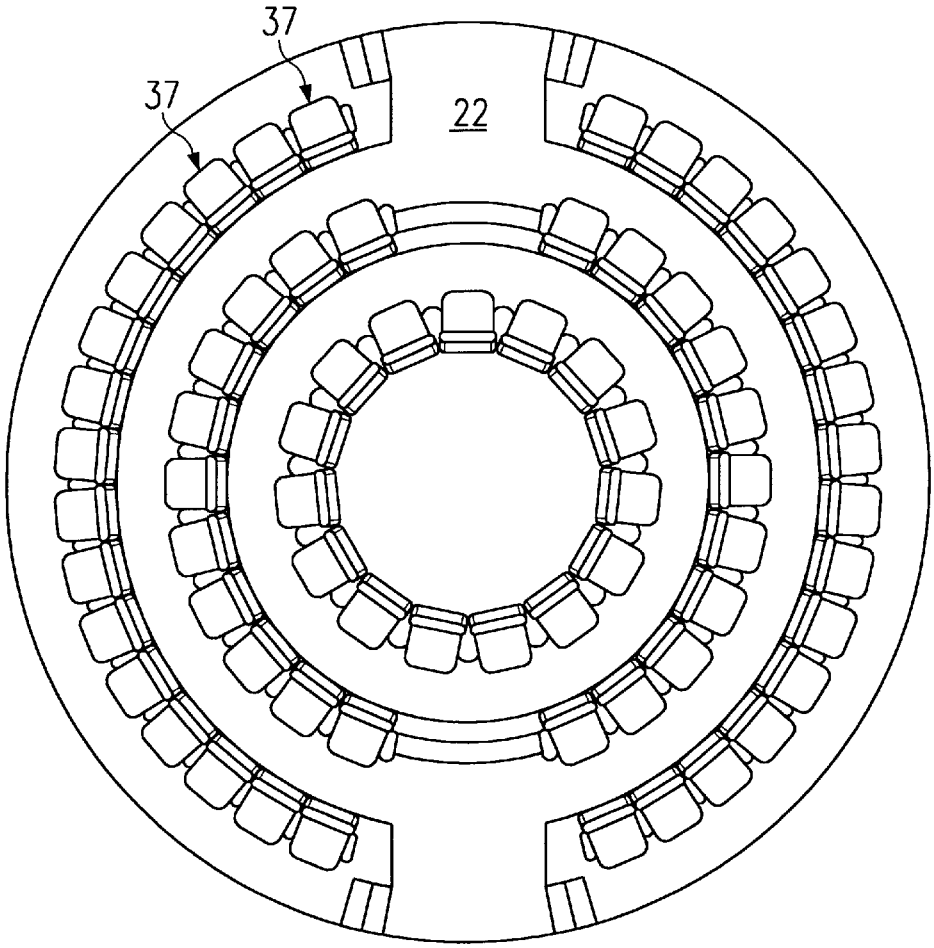
Figure 1C:
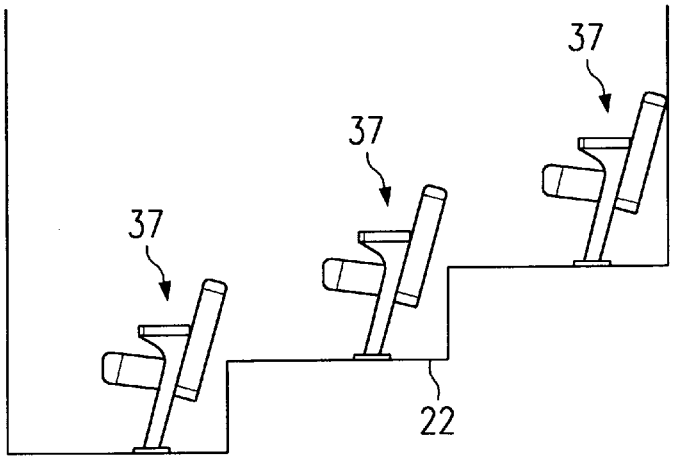

As can be seen, the center of the observatory 10 is essentially a cylindrical opening 16 defined by the inner cylindrical wall 11. According to the present invention, a carousel or platform 22 is designed to move between a first, upper position, as illustrated in the drawing, and a second, lower position 18, as illustrated in phantom 22*a*. The platform supports participants that may pay a fee to visit the attraction. In operation, the platform is loaded with participants, who may either stand or be seated in seats 33 (as shown in FIGS. 1B and 1C) or other restraining devices. Once loaded, the platform is slowly lowered between the upper position and the lower position. As the platform is lowered, it is preferably rotated so that participants have a panoramic, substantially 360° view of the fish and marine mammal life within the aquarium. Different accurate portions of the annular volume may include different exhibits. As can be seen, when the platform it in its rest position, the participants may first view the tidal pool. As the platform begins its descent into the observatory, the participants first view the dry exhibit. At this point, the platform may be paused. Thereafter, the platform is lowered at a given rate into the formal exhibition itself. As the platform is lowered, it is preferably rotated as has been described. When the observation platform reaches the lower position, it is preferably paused again for effect. Throughout the course of travel, an operator may provide aural information or music to enhance the educational or enjoyment value of the attraction. At a given time, the above-described operation is reversed and the platform is lifted back to the first position. The participates then disembark.

In the preferred embodiment, the platform 22 is supported for reciprocal and rotatable movement by telescoping column 24 located along a longitudinal axis of the structure. Preferably, telescoping column 24 is fabricated in the manner described in U.S. Pat. No. 5,564,983 to Larson, which patent is herein incorporated by reference. The type of column described in the Larson patent allows for full travel of the platform along the length of column 24.

FIG. 2 is side view of column 24 in its extended position. Column 24 consists of an inner portion 40 and an outer portion 42. Pulleys 48 are provided on the top of the outer portion 42. Cables 46 are attached from platform 22, over pulleys 48 to a fixed point on inner portion 40. The use of cables 46 is a design choice. Other suitably strong and flexible devices, such as chains, may be substituted. Outer portion 42 of column 24 is raised and lowered using known hydraulic techniques to extend and contract, respectively, piston 52 in hydraulic cylinder 50. As outer portion 42 of column 24 is raised, platform 22 moves a distance equal to twice the distance of the travel of outer column 42. This effect is caused by the need for cable 46 to extend over both the inside and outside of outer portion 42. FIG. 3 is a side view diagram of column 24 in its lowered position.

Figure 4:
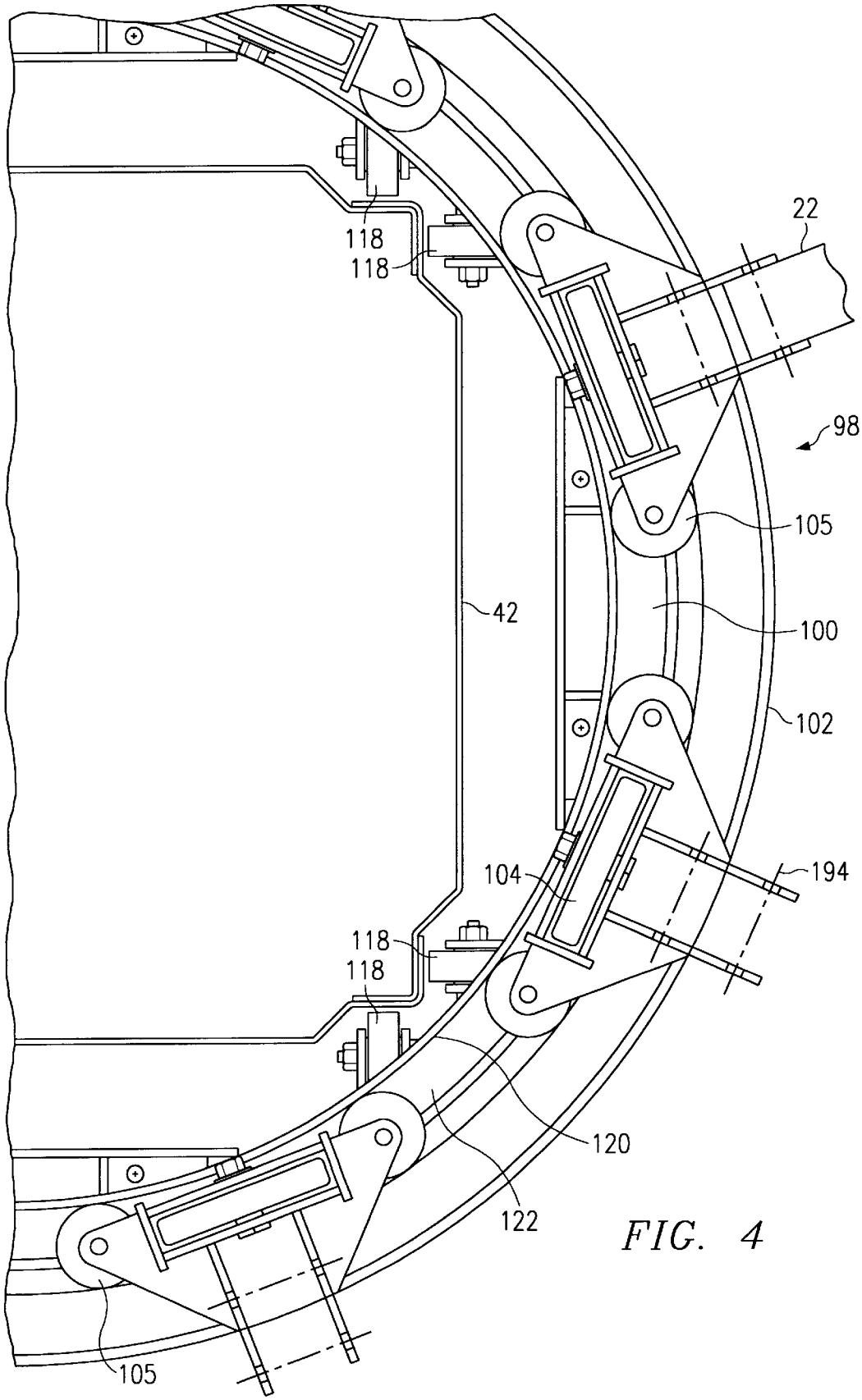
FIG. 4 is a top view of a platform support mechanism of the lift mechanism.

Additionally, in a preferred embodiment, platform 22 is allowed to rotate about column 24 under the control of electric motors (not shown). FIG. 4 is a top view of power ring 98 which supports and rotates platform 22. The power ring includes an inner ring 100. The inner ring 100 does not rotate, but can move vertically relative to the outer section 42 guided by a series of vertical guide wheels 118 mounted on inner ring 100, which bear against the outer surface of the outer section 42. Preferably, eight vertical guide wheels 118 are provided; two at each corner of outer section 42. The inner ring 100 defines an outwardly facing annular vertical surface 120 and an upwardly facing horizontal arcuate surface 122.

Power ring 98 also includes outer ring 102, which is supported on inner ring 100 through horizontal guide wheels 105 mounted on outer ring 102 that run along horizontal surface 122 which permit outer ring 102 to rotate relative the inner ring 100 about the elongate axis of column 24. Horizontal guide wheels 105 also bear against the vertical annular surface 120 to maintain concentricity of rings 100 and 102 about the axis as platform 22 rotates about the vertical axis of column 24.

One or more electric motors (not shown) are mounted on inner ring 100 and rotate outer ring 102 through fluid couplings and friction members (not shown) bearing against outer ring 102. The friction members are typically aluminum wheels with urethane tread mounted thereon which have a frictional engagement with the outer upper ring 102 assisted by a spring force.

However, any other suitable drive mechanism could be used, such as a DC motor drive, a hydraulic drive or other suitable drive mechanism. The inner end of platform 22 is secured at mounting point 194 to outer ring 102.

Returning to FIG. 1, in operation, the participants enter the observatory 10 using entrance ramp 32 and take positions on platform 22. Platform 22 is then lowered and slowly rotated to allow each participant to view the entire aquarium as has been previously described. As platform 22 is raised up back to the first position, opening 26 of the platform is aligned with exit ramp 28 to allow for the exit of the riders on the opposite portion of the entrance/exit module 30. After all riders have exited the platform, the platform 22 may be rotated to allow the entry way 26 to align with entry ramp 32 and allow for the entry of the next group of riders. This operation is not required if the platform has openings adjacent each ramp. Further, while the platform is illustrated as being fully enclosed, this is not required. Rather, a canopy may partially or fully overlay the platform. In the present embodiment, entrance/exit module 30 fully encloses cylindrical opening 16 to accentuate the effect of entering the marine world.

One of ordinary skill will appreciate that other types of lifting mechanisms may be used. Thus, the lift mechanism may merely lift the platform without rotating it. The lift may use a simple hydraulic or pneumatic jack, elevator or other known mechanism. The speed of descent of the platform may be varied throughout the extent of travel. The platform may be positioned at any height along the column. Further, the platform may be supported for movement from more than one column. Also the column may be supported or hung from the ceiling instead of supported on the floor as illustrated. Further, while the observatory is preferably formed in the configuration illustrated, this is not a requirement of the invention. The platform may have different shapes and seating configurations. First and second observatories may be positioned side-by-side and share given electrical, mechanical, hydraulic and life-support mechanisms. In an illustrative example, a first observatory may include fish while the second observatory includes marine mammals.

Having thus described my invention, what I claim as new and desire to secure by Letters Patent is set forth in the following claims:

What is claimed is:

1. An observatory, comprising:

an outer wall and a transparent inner wall defining an annulus;

a body of water enclosed within the annulus and including aquatic attractions;

a platform having a configuration fitting within the inner wall; and means for translating the platform between a first, upper position above the body of water and a second, lower position within the body of water.

2. The observatory as described in claim 1 wherein the translating means includes means for rotating the platform as the platform is moved between the first, upper position and the second, lower position.

3. The observatory as described in claim 1 wherein the platform has an outer diameter that substantially abuts the inner wall when the platform is moved between the first, upper position and the second, lower position.

4. The observatory as described in claim 1 wherein the aquatic attractions include fish.

5. The observatory as described in claim 1 wherein the aquatic attractions include marine mammals.

6. The observatory as described in claim 1 wherein the aquatic attractions include fish, marine mammals and plants.

7. The observatory as described in claim 1 wherein a given portion of the annulus includes an exhibit located above the body of water.

8. The observatory as described in claim 7 wherein the exhibit is a water exhibit illustrating a tidal pool.

9. The observatory as described in claim 7 wherein the exhibit is a dry exhibit illustrating a marine habitat.

10. The observatory as described in claim 1 wherein the observatory includes a walkway for transporting participants to the carousel when the carousel is located in the first, upper position.

11. The observatory as described in claim 1 wherein the platform includes one or more seats.

* * * * *